US005833056A

United States Patent [19]

Goldman

[11] Patent Number: 5,833,056

[45] Date of Patent: Nov. 10, 1998

[54] NON-SPILL STEADY CUP HOLDER

[76] Inventor: Jay R Goldman, 72 Aspen Dr., Woodbury, N.Y. 11797-3022

[21] Appl. No.: 820,964

[22] Filed: Mar. 19, 1997

[51] Int. Cl.[6] ..... B65D 81/02

[52] U.S. Cl. ..... 206/199; 206/162; 206/459.5; 206/562

[58] Field of Search ..... 206/139, 162, 206/199, 427, 446, 541, 546, 548, 549, 562, 563, 459.5; 229/902, 904, 932; 383/127

[56] References Cited

U.S. PATENT DOCUMENTS

| | | | |
|---|---|---|---|
| 948,524 | 2/1910 | Reid | 229/932 |
| 1,139,128 | 5/1915 | Lindberg | 229/932 |
| 1,158,349 | 10/1915 | Whalen | 229/932 |
| 1,343,252 | 6/1920 | Downing et al. | 229/932 |
| 1,349,535 | 8/1920 | Smith | 206/589 |
| 2,640,589 | 6/1953 | Foster et al. . | |
| 2,828,047 | 3/1958 | Weiselberg | 206/562 |
| 4,196,807 | 4/1980 | Brom | 206/427 |
| 4,757,937 | 7/1988 | Maio . | |
| 4,823,959 | 4/1989 | Bixler . | |
| 4,832,188 | 5/1989 | Christie | 206/162 |
| 5,044,498 | 9/1991 | Galiegue et al. | 206/427 |
| 5,205,474 | 4/1993 | Stuart et al. . | |
| 5,609,379 | 3/1997 | Harrelson | 206/192 |

*Primary Examiner*—Jimmy G. Foster
*Attorney, Agent, or Firm*—Michael I. Kroll

[57] ABSTRACT

A non-spill steady cup holder (10) for beverage containers (12) comprises a panel (14) sized to snugly fit horizontally against an interior surface (16) of a paper bag (18). A facility (20) in the panel (14) is for holding a beverage container (12). When the panel (14) is placed within the paper bag (18), the beverage container (12) will be stabilized, allowing the paper bag (18) to be carried, to prevent the beverage from spilling out of the beverage container (12), wetting the paper bag (18) and losing the beverage from the beverage container (12). In other embodiments, a second beverage container (12) can be held in the panel (14), so that two beverage containers (12) can be carried in a side by side relationship within the paper bag (18). In still other embodiments, solid food can be held in the panel (14), so that a beverage container (12) and the solid food can be carried in a side by side relationship within the paper bag (18).

6 Claims, 9 Drawing Sheets

NON-SPILL STEADY CUP HOLDER

BACKGROUND OF THE INVENTION

1. Field of the Invention

The instant invention relates generally to carry-out trays and more specifically it relates to a non-spill steady cup holder for beverage containers placed inside a paper bag.

2. Description of the Prior Art

Numerous carry-out trays have been provided in prior art. For example, U.S. Pat. Nos. 2,640,589 to Foster et al.; 4,757,937 to Maio et al; 4,823,959 to Bixler and 5,205,474 to Stuart et al. all are illustrative of such prior art. While these units may be suitable for the particular purpose to which they address, they would not be as suitable for the purposes of the present invention as heretofore described.

FOSTER, THOMAS W.

SCHECK, LEONARD E.

BRADLEY, CARL L.

DRIVEN-IN THEATER SERVICE TRAY

U.S. Pat. No. 2,640,589

An open-ended collapsible tubular tray composed of and from a single, integral and rectangular piece of fibrous sheet material such as paperboard so cut and scored that when folded it will provide substantially opposed, coextensive and spaced side walls. A bottom wall extends between the side walls and substantially from end to end of each side wall. A pair of top wall panels extend from side wall to side wall above and in spaced relation to the bottom wall. The top wall panels have adjacent edge portions spaced from one another to expose an area of the bottom wall thereby to provide a well between the tray ends. A well side panel depends from one of the adjacent edges of one of the top wall panels into contact with the upper surface of the bottom wall adjacent to the exposed area. A means is on the well side panel for effecting connection with the bottom wall. A pair of flaps have rounded sides struck from each of the top wall panels to provide portions of rounded article-receiving openings. A series of separate hinged sectors struck out from each top wall panel cooperates with the rounded flaps to complete the rounded article receiving openings. Each flap is hingedly connected to its respective top wall panel adjacent an end of the tray. A pair of tab-receiving slits are in the bottom wall, one adjacent each end thereof, and located directly beneath the hinge lines of the respective opening forming flaps. Each such flap has a locking tab portion at the end thereof projecting through the corresponding bottom wall slit and is frictionally engaged with the bottom wall at the ends of such slit.

MAIO, PATRICK S.

MURPHY, JOSEPH K.

EASY SET-UP TRAY

U.S. Pat. No. 4,757,937

An easy set-up tray wherein in addition to the usual well defined by a tray for receiving food products, there is a top panel for receiving other products, including containers for drinks and the like. Each tray is of a one-piece construction and is provided in a substantially flat knocked-down state.

When it is desired to erect or set-up the tray, side panels thereof are grasped and pulled apart with the result that the tray automatically erects and is locked in its erected or set-up position. The top panel is connected to the side panels by reversely foldable connecting panels so as to provide for a rigid structure.

BIXLER, KENNETH D.

CARRIER FOR BEVERAGE CONTAINERS

U.S. Pat. No. 4,823,959

A carrier for beverage containers is provided which includes a plurality of container-accommodating sections arranged in laterally spaced relation. Each section includes a continuous peripheral rib which delimits an opening to receive a container. The rib comprises an outer flange and an inner flange which are interconnected along corresponding upper edges. The flanges depend divergently from the interconnected upper edges. Each rib is provided with a plurality of relatively spaced shoulders extruding into the rib inner flange and forming same into a plurality of flange segments arranged in an endwise circumferentially spaced relation. Each shoulder includes a top portion extending inwardly from the interconnected flange upper edges. Depending from the top portion are opposed side portions, the latter interconnecting the top portion with corresponding ends of adjacent flange segments. A plurality of rib extensions are provided; each of which interconnects portions of the rib outer flanges of adjacent container-accommodating sections and coacts therewith to form a continuous peripheral rim which encompasses all of the container-accommodating sections.

STUART, AUREL E.

TAYLOR, WILLIAM

EASY SET-UP CARTON AND METHOD

U.S. Pat. No. 5,205,474

A blank and carry-out tray for carrying a variety of food products are provided. The tray is capable of transformation from a storage condition of a substantially flat configuration to an erect and upright useable condition by manipulation of a plurality of foldably connected portions that move similarly to a parallel linkage arrangement and which are provided with a locking mechanism that automatically lock the tray in its upright and useable condition.

SUMMARY OF THE INVENTION

A primary object of the present invention is to provide a non-spill steady cup holder that will overcome the shortcomings of the prior art devices.

Another object is to provide a non-spill steady cup holder that will stabilize one or more beverage containers within a paper bag, so that the paper bag can be carried without the beverage container spilling the beverage.

An additional object is to provide a non-spill steady cup holder that will maintain the one or more beverage containers in an upright position within the paper bag when being carried.

A further object is to provide a non-spill steady cup holder that is simple and easy to use.

A still further object is to provide a non-spill steady cup holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 2:
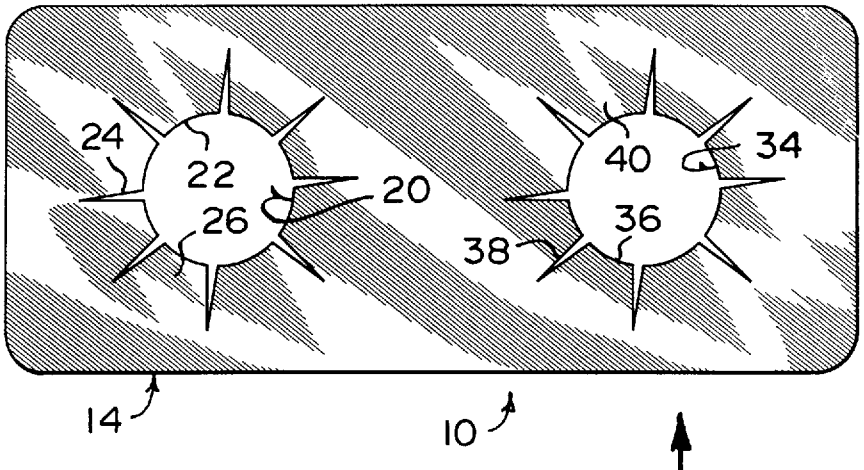
FIG. 2 is a top view of a third embodiment of the instant invention.
Figure 1:
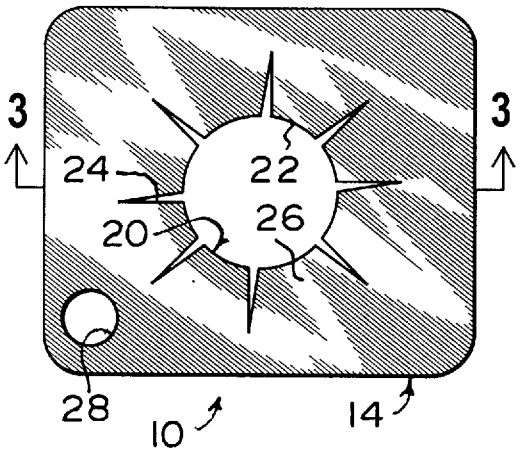
FIG. 1 is a top view of a first embodiment of the instant invention.

Turning now descriptively to the drawings, in which similar reference characters denote similar elements throughout the several views, FIGS. 1 through 13 illustrate a non-spill steady cup holder 10 for beverage containers 12 comprising a panel 14 sized to snugly fit horizontally against an interior surface 16 of a paper bag 18, as shown in FIGS. 5, 5A, 6 and 6A. A facility 20 in the panel 14, is for holding a beverage container 12. When the panel 14 is placed within the paper bag 18, the beverage container 12 will be stabilized, allowing the paper bag 18 to be carried, to prevent the beverage from spilling out of the beverage container 12, wetting the paper bag 18 and losing the beverage from the beverage container 12.

The holding facility 20, in FIGS. 1A to 7A, consists of the panel 14 having an opening 22 to receive the beverage container 12. The holding facility 20, as shown in FIGS. 1, 2, 3, 5, 6, 7 and 8 to 13 further consists of the panel 14 having a plurality of radial slits 24 extending outwardly away from the opening 22, to form a plurality of sectors 26 thereabout. When the beverage container 12 is inserted through the opening 22, the sectors 26 will bend down and press against the beverage container 12.

The panel 14, as shown in FIGS. 1, 1A, 5 and 5A, can have an aperture 28 therein, so that a drinking straw or utensil 30 can be inserted through the aperture 28 in the panel 14 when placed within the paper bag 18. FIGS. 3, 3A, 4, 4A, 5A, 6 and 6A show a flange 32 integral with and extending downwardly about the perimeter of the panel 14. The flange 32 will have more area to bear against the interior surface 16 of the paper bag 18, to better horizontally position the panel 14 therein and to add rigidity and strength to the panel 14.

In FIGS. 2, 2A and 6 through 9, a second facility 34 is in the panel 14, for holding a second beverage container 12 in a spaced apart relationship from the first beverage container 12, so that two beverage containers 12 can be safely carried together within the paper bag 18. The second holding facility 34, in FIGS. 2A and 6A, includes the panel 14 having a second opening 36 therein, to receive a second beverage container 12. The second holding facility 34, as shown in FIGS. 2, 6, 7, 8 and 9, further includes the panel 14 having a plurality of radial slits 38 extending outwardly away from the second opening 36, to form a plurality of sectors 40 thereabout. When the second beverage container 12 is inserted through the second opening 36, the sectors 40 will bend down and press against the second beverage container 12.

Figure 7:
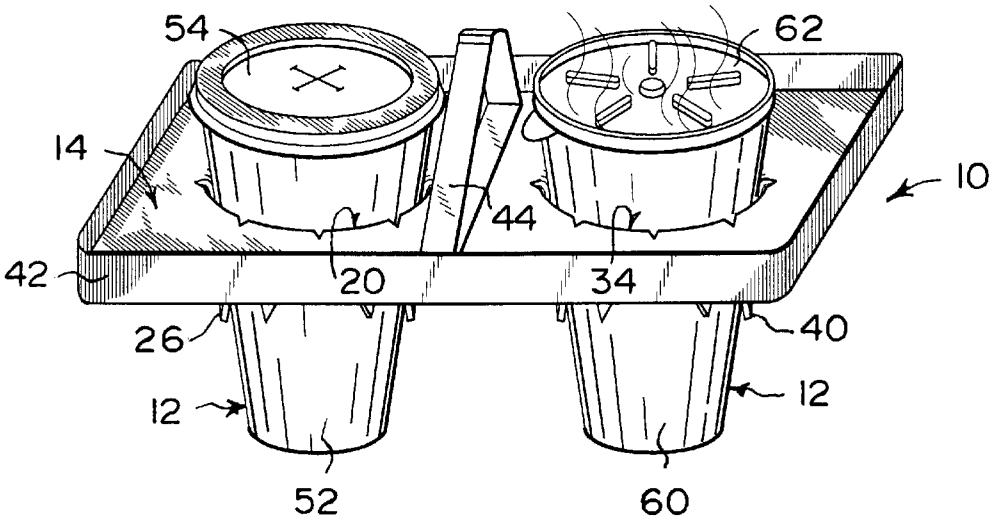
FIG. 7 is a perspective view of a fifth embodiment, holding two beverage containers.
Figure 7A:
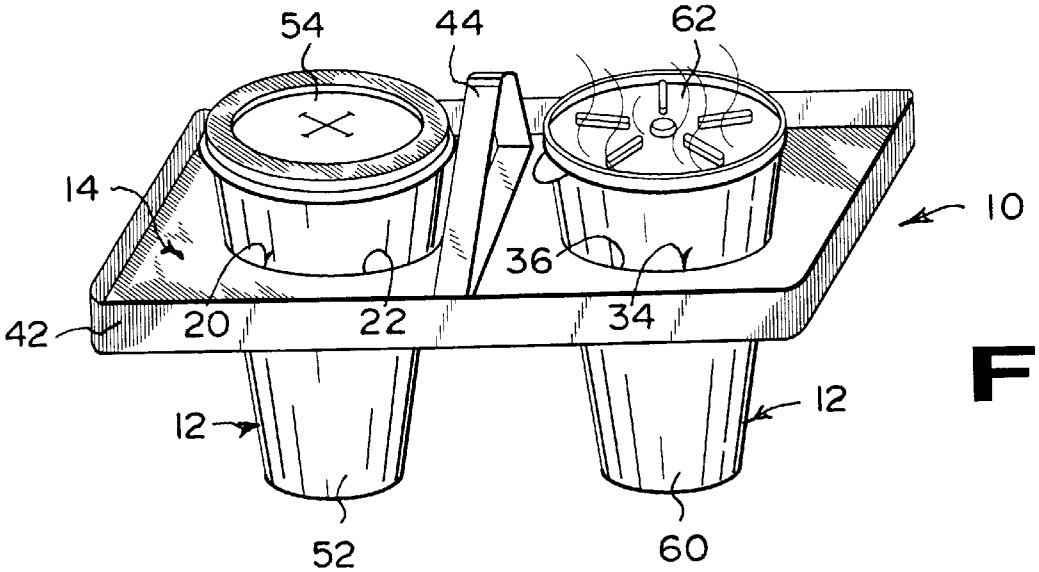
FIG. 7A is a perspective view of a sixth embodiment, holding two beverage containers.

FIGS. 7 and 7A, shows a flange 42 integral with and extending upwardly and downwardly about the perimeter of the panel 14. The flange 42 will have more area to bear against the interior surface 16 of the paper bag 18, to better horizontally position the panel 14 therein, retain spills and to increase rigidity and strength to the panel 14. A carry handle 44 extends transversely across the panel 14 between the two holding facilities 20 and 34, so that a person can transport the panel 14 by the carry handle 44 and to facilitate removal of the panel 14 from the paper bag 18.

Figure 4:
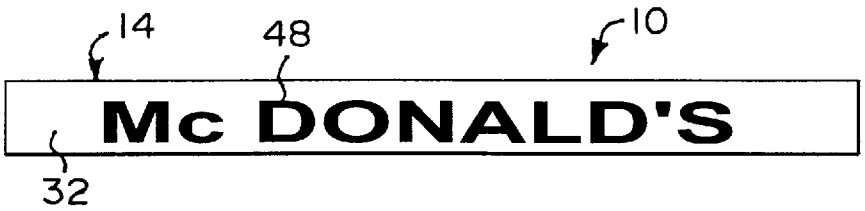
FIG. 4 is a front view of the third embodiment taken in the direction of arrow 4 in FIG. 2.
Figure 3:
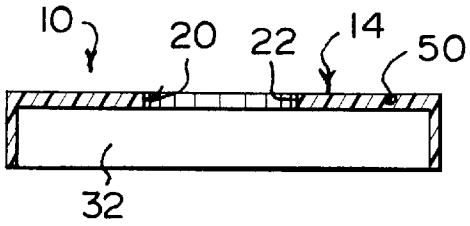
FIG. 3 is a cross sectional view of the first embodiment taken along line 3—3 in FIG. 1.
Figure 2A:
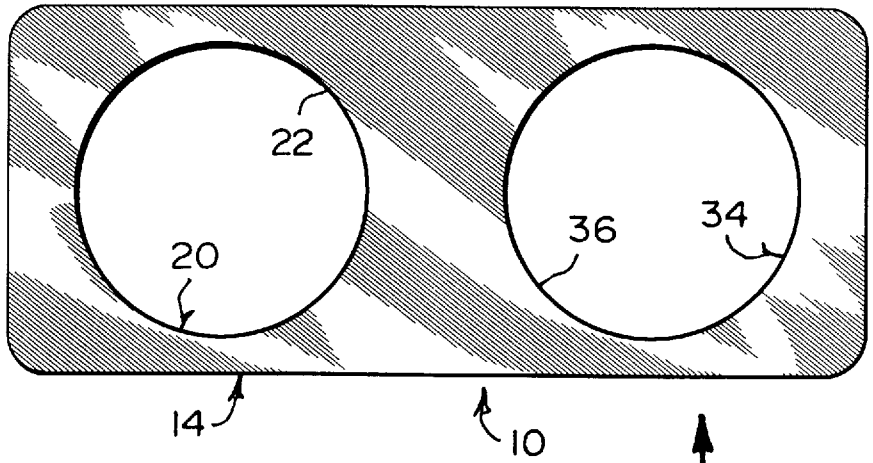
FIG. 2A is a top view of a fourth embodiment of the instant invention.
Figure 4A:
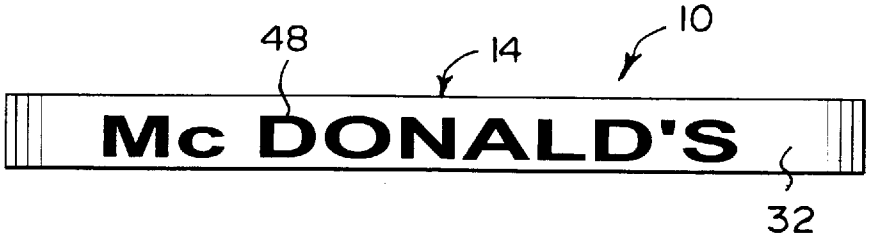
FIG. 4A is a front view of the fourth embodiment taken in the direction of arrow 4A in FIG. 2A.
Figure 1A:
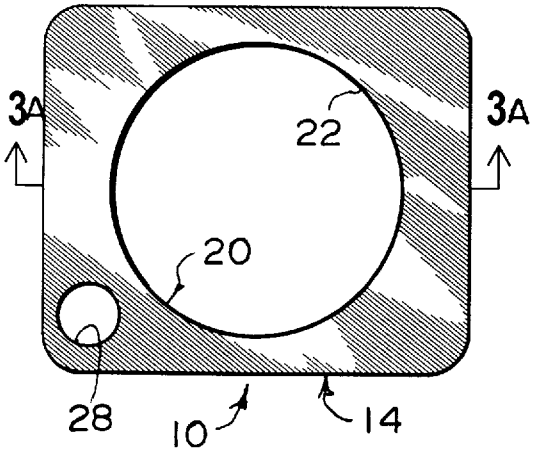
FIG. 1A is a top view of a second embodiment of the instant invention.
Figure 3A:
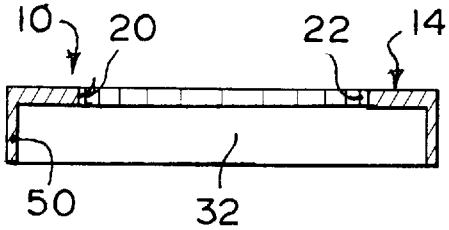
FIG. 3A is a cross sectional view of the second embodiment taken along line 3A—3A in FIG. 1A.
Figure 6:
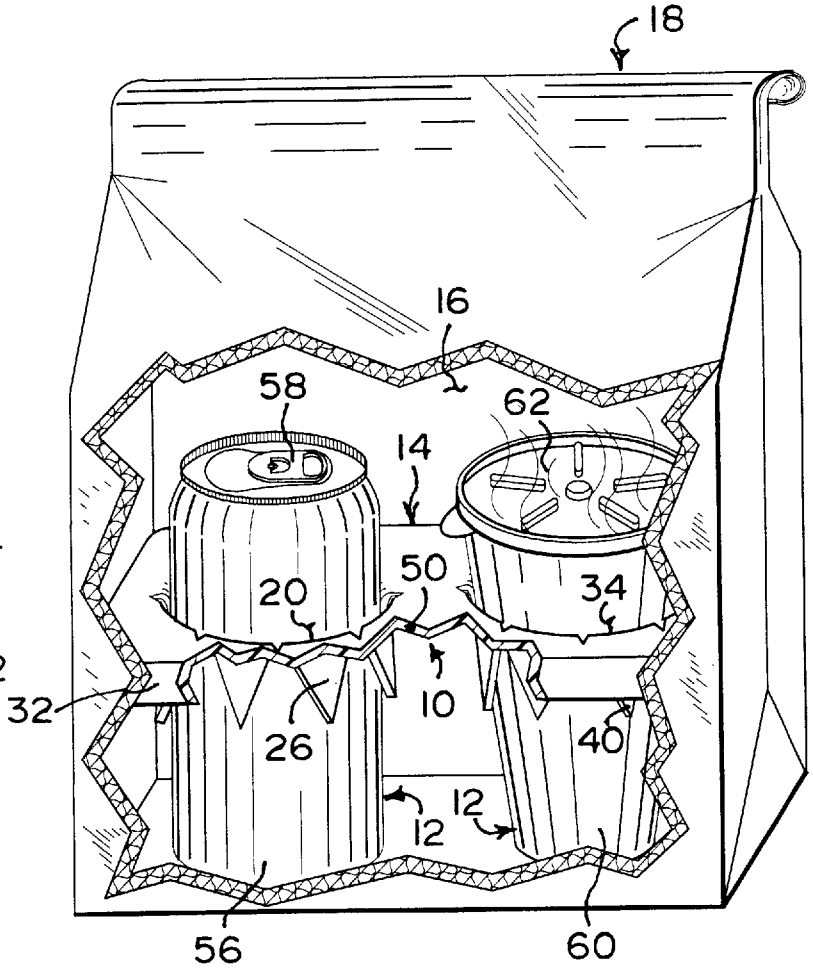
FIG. 6 is a perspective view with parts broken away, showing the third embodiment within a paper bag, holding two beverage containers therein.
Figure 5:
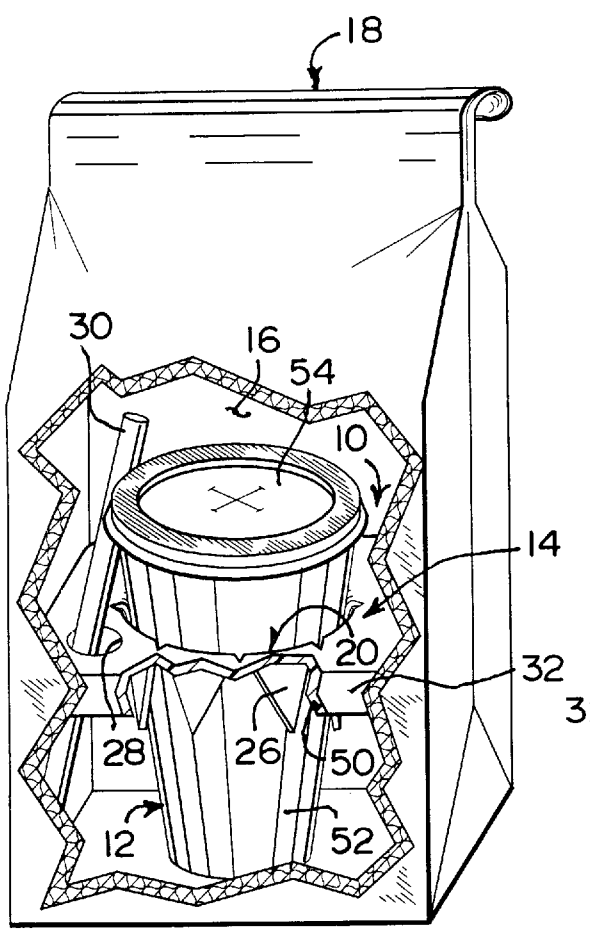
FIG. 5 is a perspective view with parts broken away, showing the first embodiment within a paper bag, holding a beverage container and straw therein.
Figure 6A:
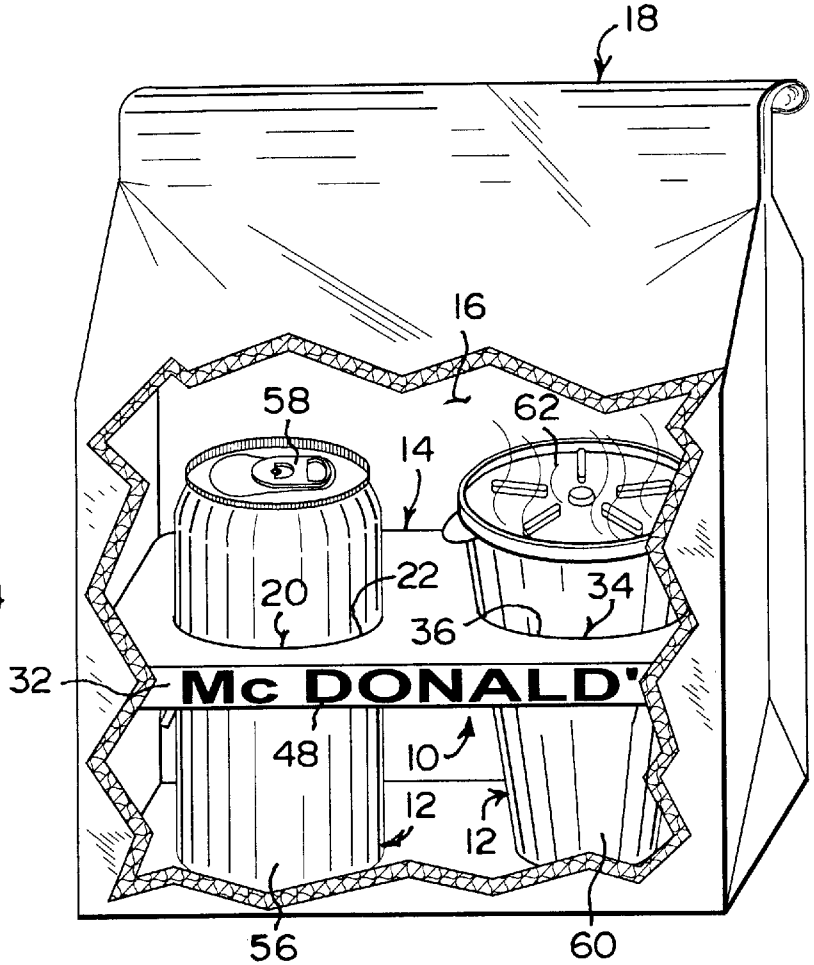
FIG. 6A is a perspective view with parts broken away, showing the fourth embodiment within a paper bag, holding two beverage containers therein.
Figure 5A:
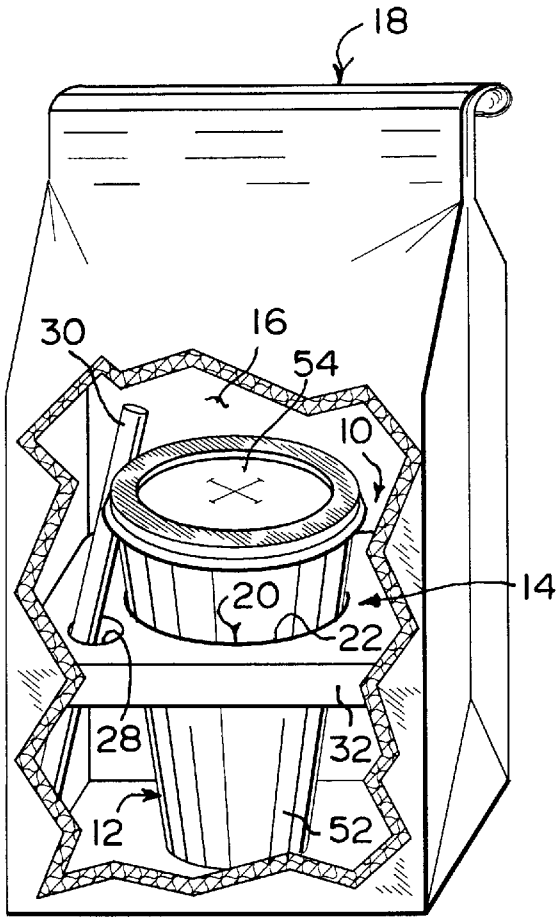
FIG. 5A is a perspective view with parts broken away, showing the second embodiment within a paper bag, holding a beverage container and straw therein.
Figure 8:
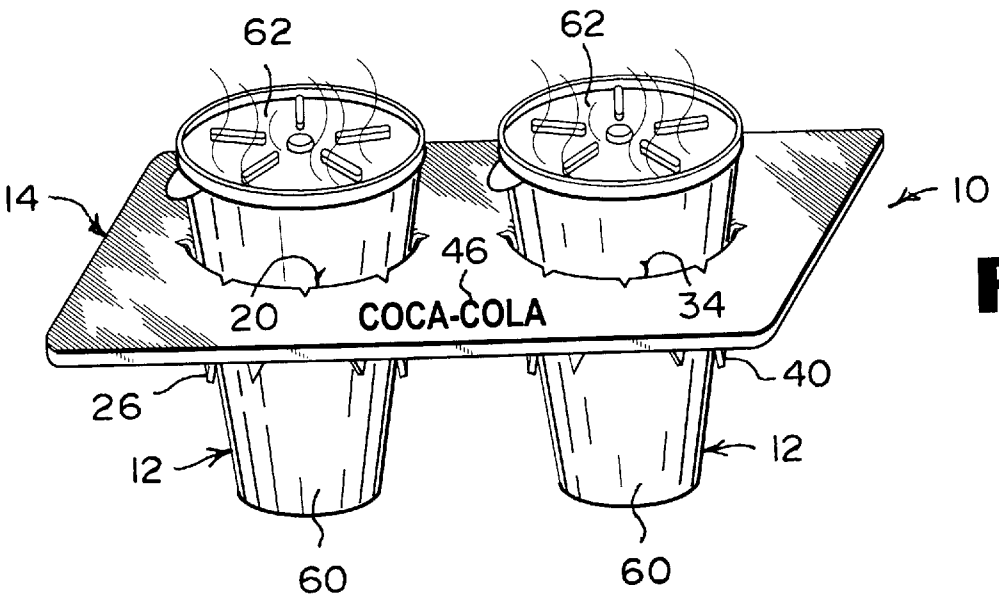
FIG. 8 is a perspective view of a seventh embodiment, holding two beverage containers.
Figure 9:
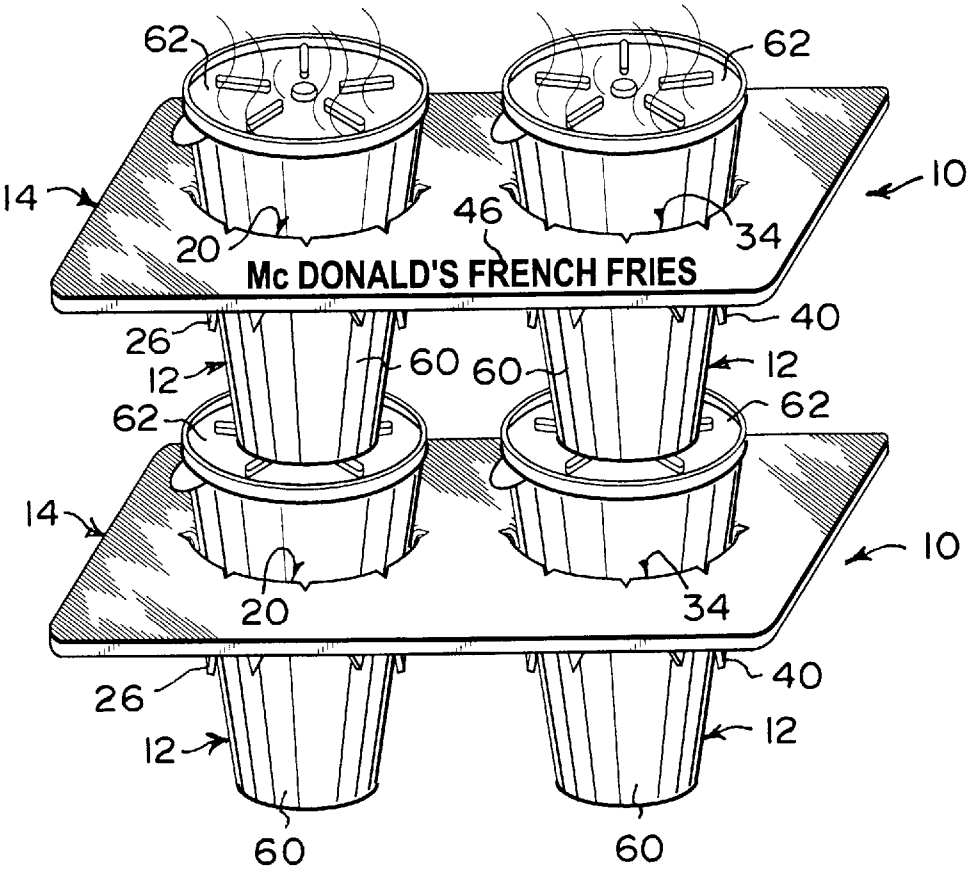
FIG. 9 is a perspective view showing two of the seventh embodiments, each holding two beverage containers that are stacked one upon the other.

As shown in FIGS. 8 and 9, advertising indicia 46 can be printed upon the panel 14. In FIG. 4, 4A and 6A, advertising indicia 48 can be printed upon the flange 32. The panel 14 can be fabricated out of a strong durable material 50, from the group consisting of plastic, cardboard and egg crate molded pulp.

The beverage container 12, as shown in FIGS. 5, 5A, 7 and 7A, is a soda cup 52 with a removable lid 54. The beverage container 12 in FIGS. 6 and 6A is a soda can 56 with a retained cap 58. The beverage container 12 in FIGS. 6 through 13, is a coffee cup 60 with a removable cover 62. The soda cup 52 and the soda can 56 are normally served cold, while the coffee cup 60 is normally served hot.

FIG. 9 shows a first set of coffee cups 60 stacked upon the covers 62 of a second set of coffee cups 60. The first set of coffee cups 60 in the first panel 14 will be inserted into the paper bag 18 first. The second set of coffee cups 60 in the second panel 14 is then inserted into the paper bag 18 on top of the covers 62 of the first set of coffee cups 60. The two sets of coffee cups 60 are stabilized within the paper bag 18 by the two panels 14.

Figure 10:
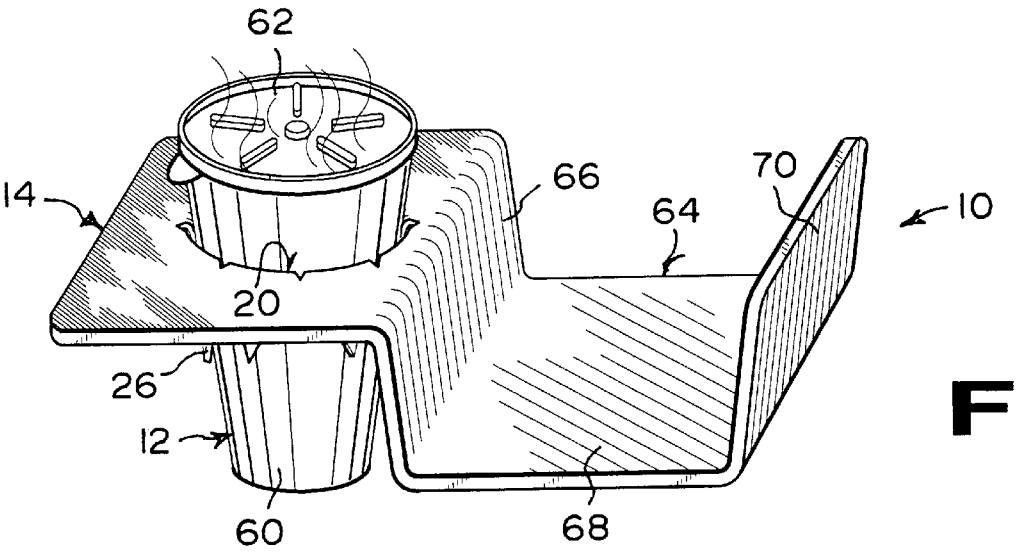
FIG. 10 is a perspective view of an eighth embodiment, holding a beverage container.
Figure 11:
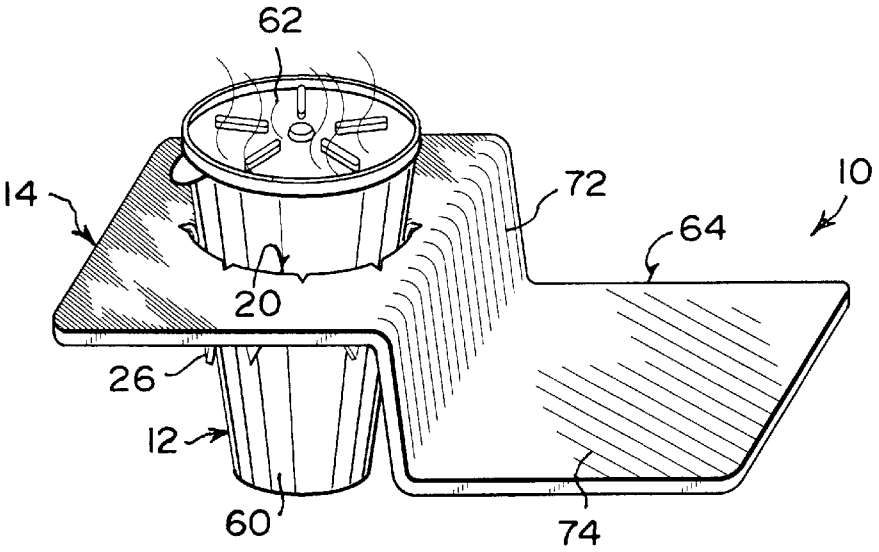
FIG. 11 is a perspective view of a ninth embodiment, holding a beverage container.
Figure 12:
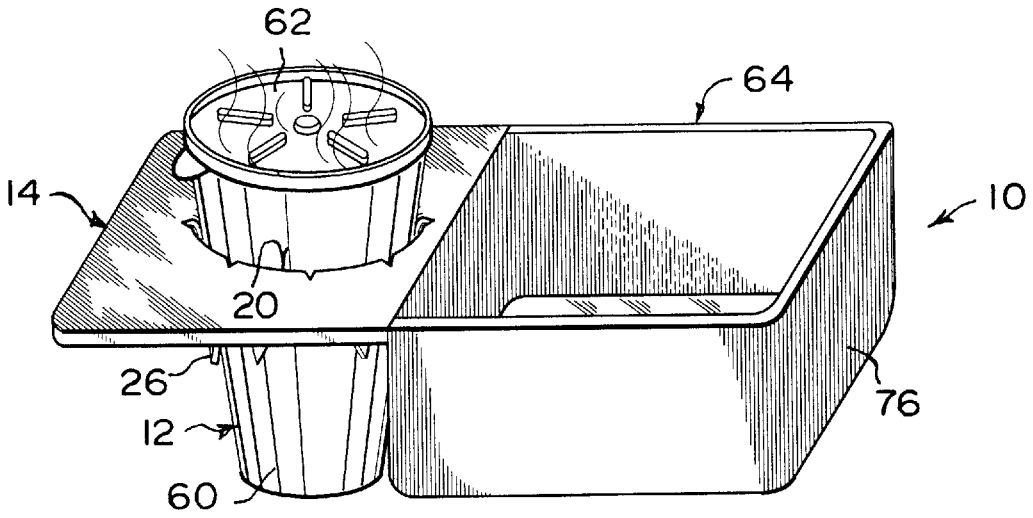
FIG. 12 is a perspective view of a tenth embodiment, holding a beverage container.
Figure 13:
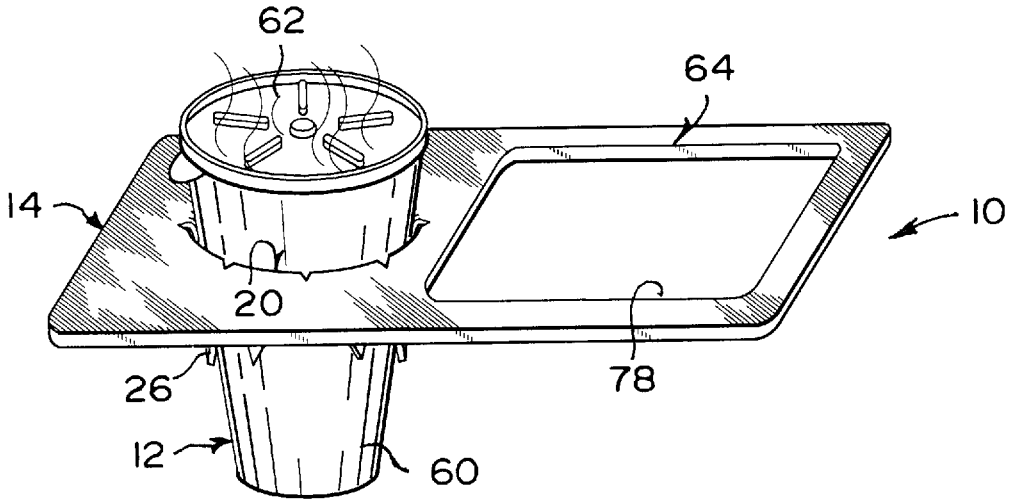
FIG. 13 is a perspective view of a eleventh embodiment, holding a beverage container.

FIGS. 10 to 13 show a structure 64 in the panel 14, for holding solid food in a spaced apart relationship from the beverage container 12, so that the beverage container 12 and the solid food can be safely carried together within the paper bag 18. The solid food holding structure 64 as shown in FIG. 10, consists of the panel 14 having a first segment 66 bent downwardly, a second segment 68 extending horizontally and a third segment 70 bent upwardly, so that the solid food can sit upon the second segment 68. The solid food holding structure 64 in FIG. 11, comprises the panel 14 having a first segment 72 bent downwardly and a second segment 74 extending horizontally, so that the solid food can sit upon the second segment 74. The solid food holding structure 64 in FIG. 12, consists of the panel 14 having an integral receptacle 76, so that the solid food can fit therein. The solid food holding structure 64 in FIG. 13, comprises the panel 14 having a large orifice 78, so that the solid food can fit therein.

LIST OF REFERENCE NUMBERS

10 non-spill steady cup holder
12 beverage container
14 panel of 10
16 interior surface of 18
18 paper bag
20 holding facility in 14
22 opening for 20 in 14
24 radial slit in 14 at 22
26 sector of 14 at 22
28 aperture in 14
30 drinking straw or utensil for 28
32 flange on 14
34 second holding facility in 14
36 second opening for 34 in 14
38 radial slit in 14 at 36
40 sector of 14 at 36
42 flange on 14
44 carry handle on 14
46 advertising indicia on 14
48 advertising indicia on 32
50 strong durable material for 14
52 soda cup for 12
54 removable lid on 52
56 soda can for 12
58 retained cap on 56
60 coffee cup for 12
62 removable cover on 60
64 solid food holding structure in 14
66 first segment of 64
68 second segment of 64
70 third segment of 64
72 first segment of 64
74 second segment of 64
76 receptacle of 64
78 large orifice of 64

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A non-spill steady cup holder for use within and in combination with a paper bag for beverage containers comprising:

a) a panel sized to fit horizontally within said paper bag;

b) means in said panel comprising a flange integral with and extending upwardly and downwardly about the complete perimeter of said panel conforming to the shape of and bearing against the interior surface of said bag, for holding a beverage container, so that when said panel is placed within the paper bag, the beverage container will be stabilized, allowing the paper bag to be carried, to prevent the beverage from spilling out of the beverage container, wetting the paper bag and losing the beverage from the beverage container;

c) said panel having an opening therein to receive the beverage container; and d) a handle formed from segments extending transversely across the top of said panel with one segment thereof against a top surface of said panel permitting said panel to be carried and to facilitate insertion of said panel into and removal from said paper bag.

2. A non-spill steady cup holder as recited in claim 1, wherein said holding means further includes said panel having a plurality of radial slits extending outwardly away from said opening to form a plurality of sectors thereabout, so that when the beverage container is inserted through said opening, said sectors will bend down and press against the beverage container.

3. A non-spill steady cup holder as recited in claim 1, further including a second means in said panel, for holding a second beverage container in a spaced apart relationship from the first beverage container, so that two beverage containers can be safely carried together within the paper bag.

4. A non-spill cup holder as recited in claim 3, wherein said second holding means includes said panel having a second opening therein to receive a second beverage container.

5. A non-spill steady cup holder as recited in claim 4, wherein said second holding means further includes said panel having a plurality of radial slits extending outwardly away from said second opening to form a plurality of sectors thereabout, so that when the second beverage container is inserted through said second opening, said sectors will bend down and press against the second beverage container.

6. A non-spill steady cup holder as recited in claim 1, wherein said panel is fabricated out of a strong durable material from the group consisting of plastic, cardboard and egg crate molded pulp.

* * * * *